United States Patent [19]

Boyanowski et al.

[11] 4,389,008

[45] Jun. 21, 1983

[54] WEB SUPPLY ROLL JOGGER

[75] Inventors: Robert E. Boyanowski, Montrose, Pa.; Floyd A. Gregory, Binghamton; Stanley E. Nemier, Endicott, both of N.Y.

[73] Assignee: International Business Machines Corporation, Armonk, N.Y.

[21] Appl. No.: 304,512

[22] Filed: Sep. 21, 1981

[51] Int. Cl.[3] ..... B65H 17/26; B65H 23/16; B65H 27/00

[52] U.S. Cl. ..... 226/123; 242/75.3; 242/76

[58] Field of Search ..... 226/123, 198, 199; 242/67.3 R, 76, DIG. 3, 75.3, 57.1

[56] References Cited

U.S. PATENT DOCUMENTS

| | | | |
|---|---|---|---|
| 2,066,307 | 12/1936 | Horton | 242/75.3 |
| 2,353,653 | 7/1944 | Croft | 242/76 |
| 2,792,884 | 5/1957 | Grimal | 242/76 X |
| 4,277,034 | 7/1981 | Buzzell | 242/67.3 R |
| 4,331,274 | 5/1982 | Halewijn et al. | 242/57.1 X |

*Primary Examiner*—Stuart S. Levy
*Assistant Examiner*—Lloyd D. Doigan
*Attorney, Agent, or Firm*—Kenneth P. Johnson

[57] ABSTRACT

Apparatus for incremental feeding of a paper web from an arborless supply roll over a transverse dancer bar resiliently supported at each end with the respective supports having different and variable spring rates to effect uneven pulling of the web during feeding and thus jogging of the supply roll. This action maintains a tight wrap of the outer layers of web on the roll and aids in maintaining web alignment during feeding.

9 Claims, 2 Drawing Figures

WEB SUPPLY ROLL JOGGER

BACKGROUND OF THE INVENTION

This invention relates generally to web feeding devices and more particularly to the feeding of a web from an arborless roll over a dancer bar.

The supply of paper for an output printer is frequently in the form of a continuous web either prefolded in the fan-fold form or in a continuous roll. In the latter form, the roll may be supported on a spindle within the printer for incremental feeding or left unsupported in an arborless roll restrained typically in a V-shaped trough or cradle. The paper is then led from the roll over a resiliently supported dancer bar to web advancement means and the print station. Arborless rolls are frequently preferred because it is simpler for a machine operator to place the roll in a trough than to place it on a spindle. In addition, there are fewer accessory pieces of equipment such as spindles or centering hubs to be assembled or stored. A common trough can frequently be used to support webs of different widths and rolls of different diameters. A further advantage of arborless rolls is the inherent braking action resulting from roll friction against the trough or roll support surface. Spindle supported rolls frequently require a braking device to control the unreeling of the web when pulled suddenly and incrementally for controlled line feeding.

The arborless roll, however, has a significant disadvantage if there is a loose layer or coil on the outside of the supply roll in the trough. This looseness can occur at the time that the paper is loaded or be caused by the pinch point where the roll contacts the trough surface which tends to introduce slack in one or more of the outer layers of paper. The loose layers do not normally diminish in size as the paper web is fed through the printer. These layers can move endwise with respect to the roll causing paper tracking problems in the printer or damaging the paper by folding over the end of the roll.

The web is frequently drawn over a resiliently supported dancer bar to absorb some of the sudden pull on the web when advanced incrementally in the printer. There is, however, little control over the feeding since the increment of advancement is a constant and the weight and friction of the roll is constantly changing due to consumption.

OBJECTS AND SUMMARY OF THE INVENTION

The primary object of this invention is to provide apparatus for incrementally feeding a web from a supply roll to a print station that results in improved alignment along the web path and at the print station.

It is another object of this invention to provide apparatus for incrementally feeding a web from an arborless supply roll in which the web layers are maintained tightly wrapped about the supply roll, thus eliminating the looseness typically found in such feeding arrangements.

Yet another object of this invention is to provide apparatus for incrementally feeding a web from an arborless supply roll over a resiliently supported dancer bar having different reactive forces when deflected by web tension.

Another important object of this invention is to provide apparatus for incrementally feeding a web from an arborless supply roll over a resiliently supported dancer bar having different and changeable reactive forces on opposite ends of the bar during deflection.

The foregoing objects are attained by providing cradle means for holding the supply roll of a paper web, and means for gripping the web and incrementally pulling the web end from the roll over a resiliently supported dancer bar arranged transversely of the web. The dancer bar is supported at each end by means permitting deflection thereof but the resilient support means each has a different rate of deflection versus load during the latter portion of the deflection. This imparts a slight skew to the roll in the cradle resulting in take-up of slack or looseness in the outer layers of the supply roll.

The effect of this skew is to repeatedly jerk or yank the paper web at one end of the supply roll, urging the roll toward one end of the cradle, and taking up any slack by a small amount with each pull on the web until all slack is removed and then maintaining the tightly wrapped coil thereafter. The urging of the roll to one end of the cradle and the tightly wrapped roll significantly reduce misalignment of the web as it is fed through a subsequent print station.

The foregoing and other objects, features and advantages of the invention will be apparent from the following more particular description of a preferred embodiment of the invention, as illustrated in the accompanying drawing.

DETAILED DESCRIPTION OF A PREFERRED EMBODIMENT OF THE INVENTION

Figure 1:
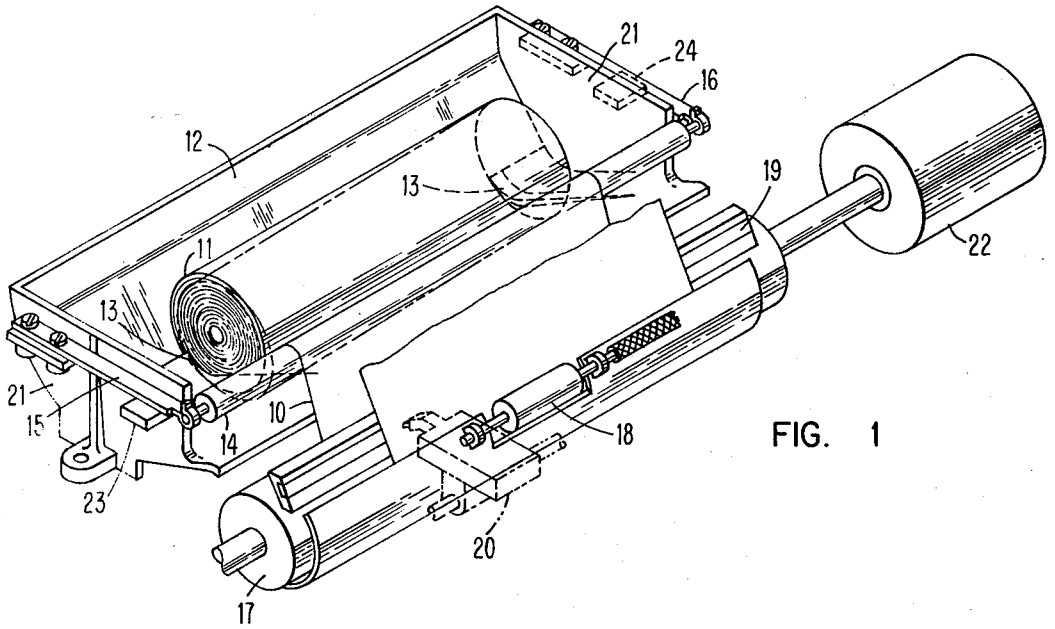
FIG. 1 is a perspective view of a web feeding device constructed in accordance with the principles of the invention.
Figure 2:
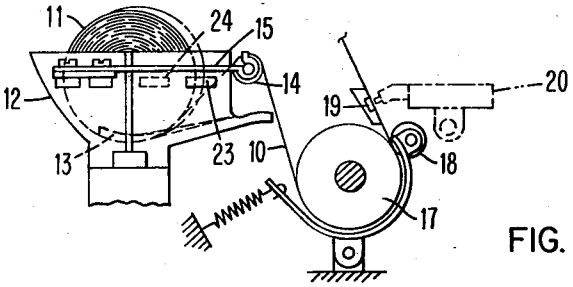
FIG. 2 is an end view of the web feeding device in FIG. 1 showing the stops for the resilient supports of the dancer bar.

Referring to FIGS. 1 and 2, paper web 10 in the form of an arborless supply roll 11 rests in a molded V-shaped trough or cradle 12. The unwound portion of the web follows a path from the bottom of the roll upwardly to the right over a rotatable blousing or dancer bar 14 supported at each end by leaf springs 15 and 16 of equal length affixed to opposite ends of cradle 12 and allow the dancer bar to deflect downwardly as web tension is applied. Thereafter the web path is downwardly about feed roller 17, then between the feed roller and pressure roller 18 and upwardly over print platen 19 in front of print head 20 shown in phantom.

The paper web 10 is pulled from supply roll 11 by tension and the roll is freely rotatable within cradle 12 and is centered by a pair of abutments 13 near either end. The cradle length provided between abutments is slightly greater than the length of the roll to permit unhampered rotation as the web is pulled causing the roll to rotate counterclockwise. Roll length can extend approximately to end walls 21 or the cradle can be formed with successively narrower and lower pairs of abutments 13 to accept rolls of narrower webs. In addition, the cradle surfaces, if desired, can be formed with friction pads (not shown), to support the supply roll at fewer points.

Web 10 is pulled from its supply roll by intermittent operation of step motor 22 that incrementally rotates feed roller 17 when a line advance is required by the printer. The print mechanism 20 is translatable along the width of the web. The incremental rotation of the motor and feed roller produces sudden tension on the web causing dancer bar 14 to deflect downwardly thus applying a more gradual tension to the web as the web attempts to unwind and turn the supply roll. Actually, most of the increment of web advancement is unwound during restoration of the dancer bar by its resilient supports which occurs after the web has been advanced at the print station.

The web feeding arrangement as described thus far is well-known. However, it has been found that the one or more loose layers on the roll are produced as a result of loading the roll or the friction and pressure caused by the weight of the roll on its cradle. As a result, the loose layers of paper tend to telescope and move beyond one end of the supply roll to become wrinkled or produce subsequent misalignment at the print station.

It has been found that the uncoiling of surplus web can be avoided by using different spring rates for the resilient supports 15 and 16 for the dancer bar. This is accomplished by providing a respective abutment or stop 23, 24 for each leaf spring 15 and 16. Each stop is affixed to an end wall 21 of cradle 12 beneath its respective leaf spring. It will be noted that stop 23 for leaf spring 15 is placed nearer the dancer bar than stop 24 for leaf spring 16. The stops are placed so as to be spaced downwardly from and out of contact with the leaf springs when no tension is applied to the web. The stops are placed at different distances along the spring length from the dancer bar ends and engage the leaf springs at different times during downward movement of the dancer bar.

The effect of the stops is to increase the spring rate of each leaf spring, but by different amounts, due to their different locations. As the dancer bar is deflected under load due to tension on the web, the effect of this arrangement of stops and leaf springs is to allow normal movement of the dancer bar for a portion of the deflection and then require a greater force for the remainder of the deflection. This causes the web to be pulled from one end of the supply roll 11 before the web reaches sufficient pulling tension at its opposite end. The uneven tension on the web caused by the sudden change in spring deflection skews the roll a small amount causing it to jog slightly (shown in phantom) within its cradle with one end rising up the cradle slope further than the other. This jogging action removes slack from loose layers of the roll on first one end during the line feed operation and then the other end as the roll unwinds and slides back to its rest position on the cradle and the dancer roll returns to its normal position after the line feed operation. The skewing and jogging of the roll with each incremental advance of the web tend to keep the roll tightly wound and also urge and maintain the roll toward the end of the cradle having the dancer roll support with the weaker spring rate. It has been found that a loose layer on the roll caused during insertion of a new roll will be tightly wound after several line advances and before any telescoping action occurs.

It has been found that different roll weights or web compositions will have individual optimum spring rates for the most efficient feeding. If the arrangement shown is not adequate, the dancer bar support arrangement can be made to accommodate particular roll requirements by making the locations of stops 23 and 24 adjustable. Another alternative is to use leaf springs having different spring rates or lengths in conjunction with the stops. It will be also noted that the dancer bar need not be rotatable but may be fixed with respect to the springs.

The dancer bar end may be located in a slot using compression or extension springs in place of leaf springs.

In some instances one end of the dancer bar may be rigidly, or unyieldingly mounted while the opposite end only is resiliently supported. This also produces a skew in the supply roll but may increase the web feeding noise appreciably.

While the invention has been particularly shown and described with reference to a preferred embodiment thereof, it will be understood by those skilled in the art that various changes in form and details may be made therein without departing from the spirit and scope of the invention.

What is claimed is:

1. Apparatus for feeding a web from a supply roll comprising:

cradle means for holding said supply roll;

feeding means operable for gripping said web to incrementally pull said web from said roll;

a dancer bar arranged transversely of said web between said roll and said feeding means about which said web is pulled; and resilient support means for each end of said bar for permitting deflection of said bar when said web is pulled, each said support means having a rate of deflection versus load different than the other support means during at least part of the deflection of said bar whereby said bar deflects in response to the tension of said web and said roll is momentarily skewed in said cradle means when said feeding means is operated.

2. Apparatus as described in claim 1 wherein said web is pulled from the underside of said supply roll over said dancer bar.

3. Apparatus as described in claim 1 wherein said support means includes means to change the rate of deflection versus load during deflection of said dancer bar.

4. Apparatus described in claim 1 wherein said support means includes at least one abutment engagable by an arm during deflection of said bar.

5. Apparatus as described in claim 1 wherein said support means includes an abutment for each support means at a different distance from said dancer bar.

6. The method of pulling a web from an arborless supply roll restrained in a cradle comprising the steps of:

feeding said web along a path from said roll about a transverse dancer bar mounted on at least one resilient support;

pulling on the web by impulses downstream from said bar to unwind an increment of said web and deflect said bar with each said impulse; and abruptly changing the rate of deflection versus load for said resilient support member during deflection of said bar to thereby pull unevenly on said web and skew said supply roll in said cradle.

7. The method as described in claim 6 wherein the step of changing said deflection rate comprises placing abutments at different relative positions from said dancer bar for each resilient support.

8. The method as described in claim 6 wherein said dancer bar is supported at each end by a leaf spring engagable with an abutment during deflection of said dancer bar.

9. The method as described in claim 6 wherein said dancer bar is supported on a pair of resilient support members each having a different rates of deflection during deflection of said bar.

* * * * *